US005564570A

United States Patent [19]

Jaszai

[11] Patent Number: 5,564,570

[45] **Date of Patent: *Oct. 15, 1996**

[54] IMPACT-RESISTANT WRAPPING SYSTEM

[75] Inventor: Zoltan K. Jaszai, Tokyo, Japan

[73] Assignee: Burlington Consolidated Limited Incorporation, Dublin, Ireland

[ * ] Notice: The term of this patent shall not extend beyond the expiration date of Pat. No. 5,476,175.

[21] Appl. No.: 251,962

[22] Filed: Jun. 1, 1994

[30] Foreign Application Priority Data

Jun. 1, 1993 [JP] Japan ..... 5-130796

[51] Int. Cl.[6] ..... B65D 81/14

[52] U.S. Cl. ..... 206/523; 206/522; 206/219; 206/213.1

[58] Field of Search ..... 206/213.1, 219, 206/522, 523; 383/3

[56] References Cited

U.S. PATENT DOCUMENTS

| | | | |
|---|---|---|---|
| 2,118,165 | 5/1938 | Christopher et al. | 206/522 |
| 3,096,148 | 7/1963 | Walker, Jr. | 206/213.1 |
| 3,412,521 | 11/1968 | Bauman . | |
| 3,889,743 | 6/1975 | Presnick | 206/522 |
| 4,155,453 | 5/1979 | Ono . | |
| 4,193,499 | 3/1980 | Lookholder . | |
| 4,262,801 | 4/1981 | Avery . | |
| 4,295,566 | 10/1981 | Vincek . | |
| 4,620,633 | 11/1986 | Lookholder . | |
| 4,905,835 | 3/1990 | Pivert et al. | 206/522 |
| 4,924,899 | 5/1990 | Po . | |
| 5,009,318 | 4/1991 | Lepinoy . | |
| 5,042,663 | 8/1991 | Heinrich . | |
| 5,129,519 | 7/1992 | David et al. . | |
| 5,180,060 | 1/1993 | Forti et al. | 206/522 |
| 5,348,157 | 9/1994 | Pozzo | 206/522 |
| 5,402,892 | 4/1995 | Jaszai | 206/522 |
| 5,427,830 | 6/1995 | Pharo | 383/3 |

FOREIGN PATENT DOCUMENTS

| | | | |
|---|---|---|---|
| 0434447 | 6/1991 | European Pat. Off. . | |
| 2277006 | 1/1976 | France . | |
| 2674411 | 10/1992 | France | 206/522 |
| 51-93720 | 7/1976 | Japan . | |
| 54-136985 | 10/1979 | Japan . | |
| 2184997 | 7/1987 | United Kingdom . | |
| 2230509 | 10/1990 | United Kingdom . | |
| 87/02012 | 4/1987 | WIPO . | |

*Primary Examiner*—David T. Fidei
*Attorney, Agent, or Firm*—Wenderoth, Lind & Ponack

[57] ABSTRACT

An impact-resistant wrapping system includes at least one or two the sheetlike wrapping bodies having an elastic impact-resistant material compressed and accommodated in a cavity surrounded by flexible wall members having gas-barrier properties. The sheetlike wrapping body is foldable to conform to a ceiling surface, a bottom surface and side surfaces of a box. An air valve is mounted in the flexible wall member for ensuring and disrupting communication between the external space and the cavity of the sheetlike wrapping body.

3 Claims, 12 Drawing Sheets

IMPACT-RESISTANT WRAPPING SYSTEM

BACKGROUND OF THE INVENTION

1. Field of the Invention

The present invention relates to an impact-resistant wrapping system and, more particularly, to improvements in impact-resistant wrapping performance in an impact-resistant wrapping system arranged in a box along a ceiling surface, a bottom surface and side surfaces of the box to wrap an article which is accommodated in the box.

2. Description of the Prior Art

One example of a known prior art, impact-resistant wrapping system comprises flexible, synthetic, thin plates having a continuous three-dimensional pattern. The impact-resistant wrapping system is arranged in a box, for wrapping an article in the box to provide impact resistance.

Single-layered or multilayered thin plates of this prior art system are arranged in a box along the bottom and side surfaces of the box except for its ceiling surface. An article is accommodated in the box, and a single-layered or multilayered thin plate is then placed on the article inside the ceiling surface of the box to close the ceiling surface of the box. This impact-resistant wrapping system effects the impact-resistant wrapping of the article by the elastic force of the flexible three-dimensional pattern.

Although this prior art system is interposed between the box and the article to hold the article with a certain elastic force, the play of the article inside the box cannot be perfectly eliminated, and the impact-resistant wrapping performance is consequently inadequate.

As examples of a wrapping system for wrapping an article to be transported, an inflatable package has been proposed which is made up of an air bag having an impact-resistant space for accommodating the article, proposed in Japanese Patent-Application Public Disclosure No. SHO 54-136985, No. SHO 63-502099 (corresp. to International Application No. PCT/US86/01989) and U.S. Ser. No. 08/113660.

In the above-mentioned prior art systems, the article is shifted in the package according to the motion of the package, even if the package is inflated.

OBJECT OF THE INVENTION

The present invention has been made in consideration of the conventional drawbacks described above, and its object is to provide an impact-resistant wrapping system having a high impact-resistant wrapping performance and being capable of properly fixing an article inside a box.

SUMMARY OF THE INVENTION

In order to achieve the above object of the present invention, an impact-resistant wrapping system is provided comprising at least one or two sheetlike wrapping bodies and having an elastic impact-resistant material which is compressed and accommodated in a cavity surrounded by flexible wall members having gas-barrier properties, while the sheetlike wrapping body is foldable to conform to a ceiling surface, a bottom surface and side surfaces of a box, and there is an air valve which is mounted in the flexible wall member for ensuring and disrupting communications between an external space and the cavity of the sheetlike wrapping body.

According to the above impact-resistant wrapping system, the sheetlike wrapping body has substantially the same application form as that of the prior art. Before or after the ceiling surface of the box is closed, the air valve is opened to inject air inside the cavity of the sheetlike wrapping body in order to expand the impact-resistant material so that the sheetlike wrapping body is pressed against the box and the article with much elastic force, thereby providing an impact-resistant wrapping system having high impact-resistant wrapping performance capable of properly fixing the article inside the box. Note that air inside the cavity of the sheetlike wrapping body is exhausted through the air valve, and then the air valve is closed, allowing thereby the reuse of the wrapping system.

The article can be properly fixed inside the box to improve the impact resistant, that is, then wrapping performance, because the sheetlike wrapping body, which is interposed between the box and the article, is expanded in order to press it against both the box and the article with much elastic force.

An impact-resistant wrapping system is provided comprising at least one or two sheetlike wrapping bodies having an elastic-impact resistant material which is compressed and accommodated in a cavity surrounded by flexible wall members having gas-barrier properties, while the sheetlike wrapping body is foldable to conform to a ceiling surface, a bottom surface and side surfaces of a box. A gas generating capsule, which has at least a portion permeable only to a gas, is accommodated in the cavity of the sheetlike wrapping body. At least two types of materials for generating a gas to inflate the cavity of the sheetlike wrapping body upon being mixed with each other, are separately sealed and can be mixed with each other upon being pressed, while an air valve is mounted in the flexible wall member for ensuring and disrupting communications between an external space and the cavity of the sheetlike wrapping body.

According to the above impact-resistant wrapping system, the sheetlike wrapping body has substantially the same application form as that of the conventional example. Before or after the ceiling surface of the box is closed, the gas generating capsule is depressed to fill the inside the cavity of the sheetlike wrapping body with gas in order to expand the cavity, so that the sheetlike wrapping body is pressed against the box and the article with much elastic force, providing thereby an impact-resistant wrapping system having high impact-resistant wrapping performance capable of properly fixing the article inside the box. Note that the gas inside the cavity of the sheetlike wrapping body is exhausted through the air valve after its use, while gas, air or the like is injected through the air valve in order to use the wrapping system again.

By adding the operation of an air valve, the wrapping operation of an article is simplified.

In addition, the system can be used again thanks to the operation of the air valve.

Other and further objects of the present invention will become obvious upon understanding the illustrative embodiments about to be described or will be indicated in the appended claims, and various advantages not referred to herein will occur to one who is skilled in the art upon putting the invention in to practice.

BRIEF DESCRIPTION OF THE DRAWINGS

The objects and features of the present invention will be hereinafter explained in detail with reference to the accompanying drawings, in which:

FIG. 5 is a sectional view showing a state wherein wrapping has been completed from the state shown in FIG. 2 on;

DESCRIPTION OF THE PREFERRED EMBODIMENTS

Impact-resistant wrapping systems according to the preferred embodiments of the present invention will be described with reference to the accompanying drawings.

FIGS. 1 to 5 show an impact-resistant wrapping system according to a first embodiment of the present invention.

Figure 1:
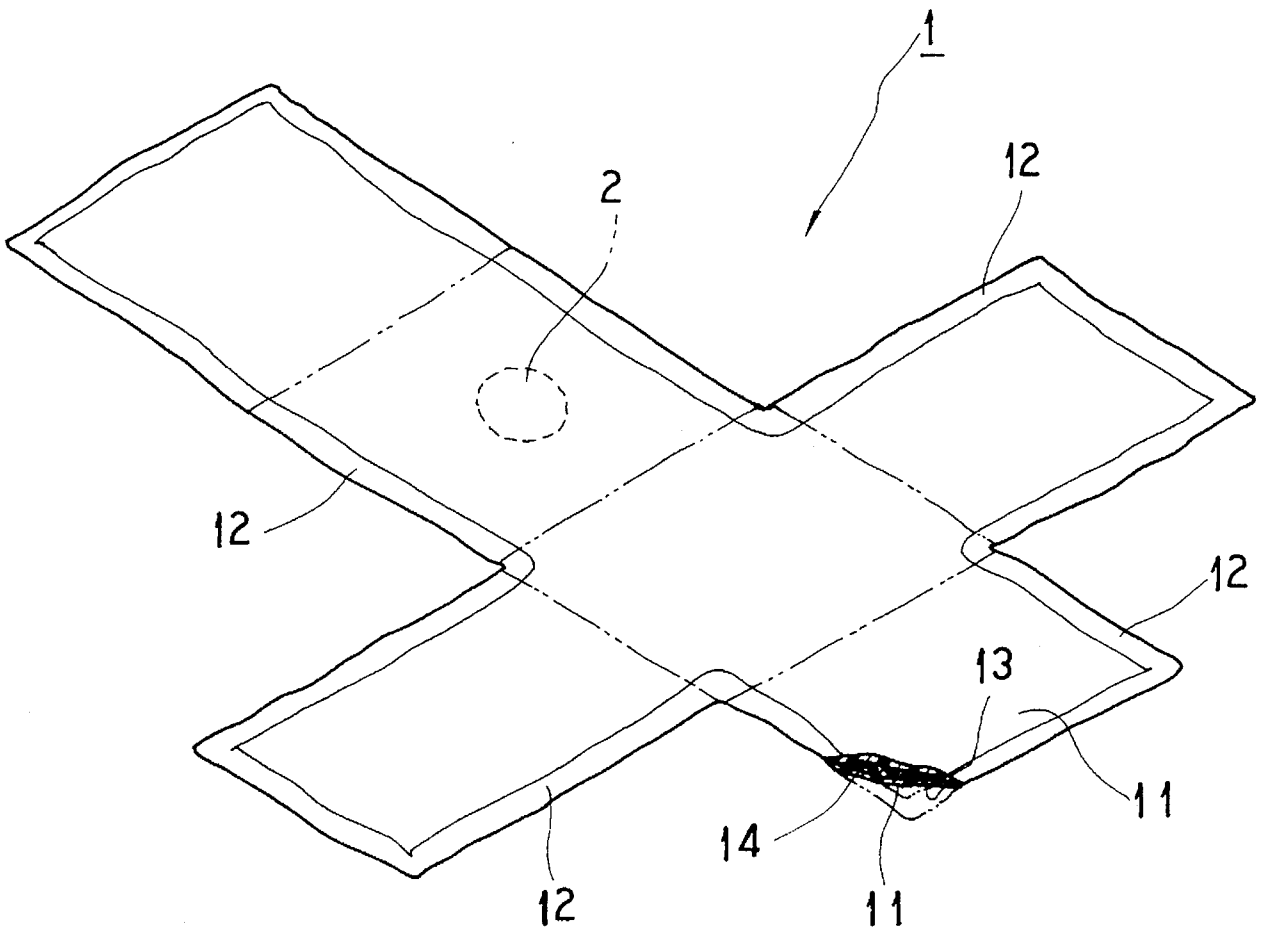
FIG. 1 is a partially cutaway, perspective view showing an impact-resistant wrapping system according to a first embodiment of the present invention.

As shown in FIG. 1, a sheetlike wrapping body 1 of this embodiment comprises a single body having seal portions 12 formed by adhesive application or thermal-solvent welding at overlapping edge portions of two cross-shaped flexible wall members 11. A cavity 13, which is surrounded by the flexible wall members 11, is formed inside the sheetlike wrapping body 1. The flexible wall members 11 have gas-barrier properties which prevent gas permeation or they have a very low permeability, that is, the flexible wall members are substantially gas impermeable, in addition to flexibility (FIG. 2) which provides foldability for the flexible wall members 11 to conform to the six surfaces, i.e. the ceiling surface, the four side surfaces and the bottom surface, of a box C. Each flexible wall member 11 consists of a single-layered synthetic-resin film, a multilayered, laminated synthetic-resin or metal film or the like. An elastic, impact-resistant material 14 consisting of a foamed resin or the like is compressed and stuffed inside the cavity 13 in a deaerated state.

An air valve 2 for ensuring and disrupting communication between external space and the cavity 13 of the sheetlike wrapping body 1 is mounted in one flexible wall member 11 of the sheetlike wrapping body 1.

Figure 3:
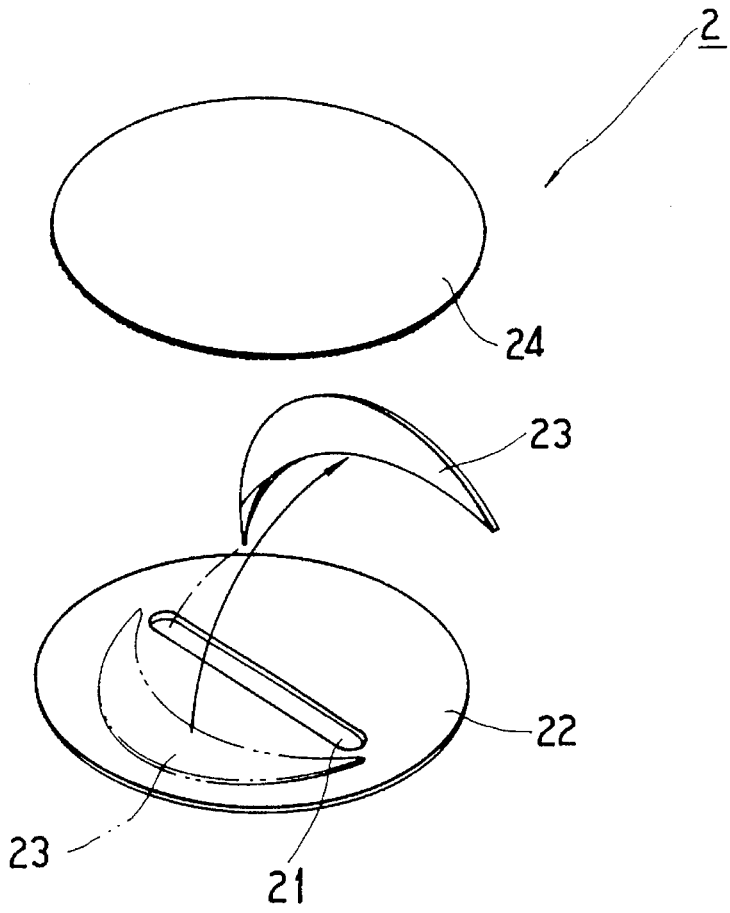
FIG. 3 is an enlarged perspective view showing a main part (air valve) of FIG. 1.
Figure 4:
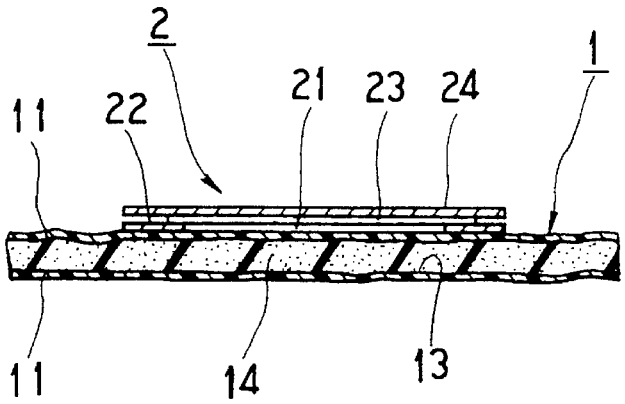
FIG. 4 is a sectional view of the main part of FIG. 3.
Figure 5:
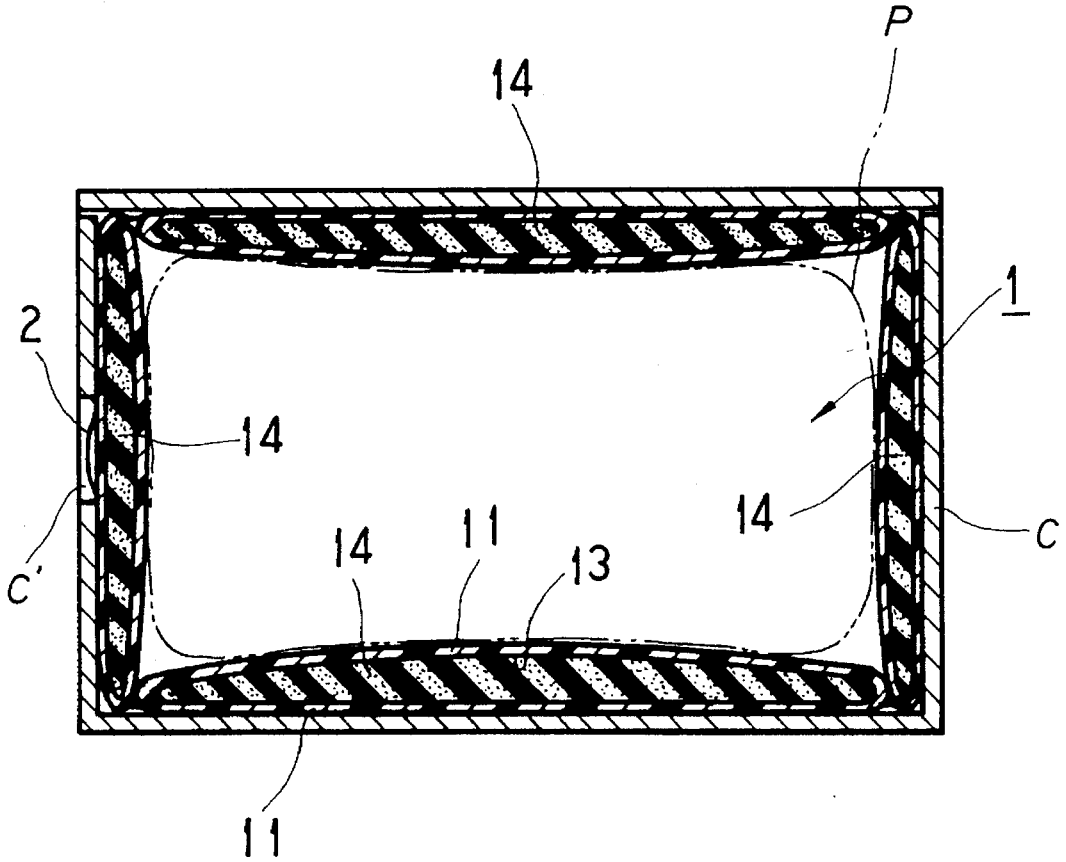

As shown in FIGS. 3 and 4, the air valve 2 comprises a disklike base 22 having a central slit 21 and it is fixed on to the outer surface of flexible wall member 11 of the sheetlike wrapping body 1. A crescent cutter 23 is placed on the surface of the base 22, and there is a disklike seal 24 to which an adhesive capable of performing repeated adhesion and peeling is applied and which is adhered to the surface of the the base 22 through the cutter 23.

Figure 2:
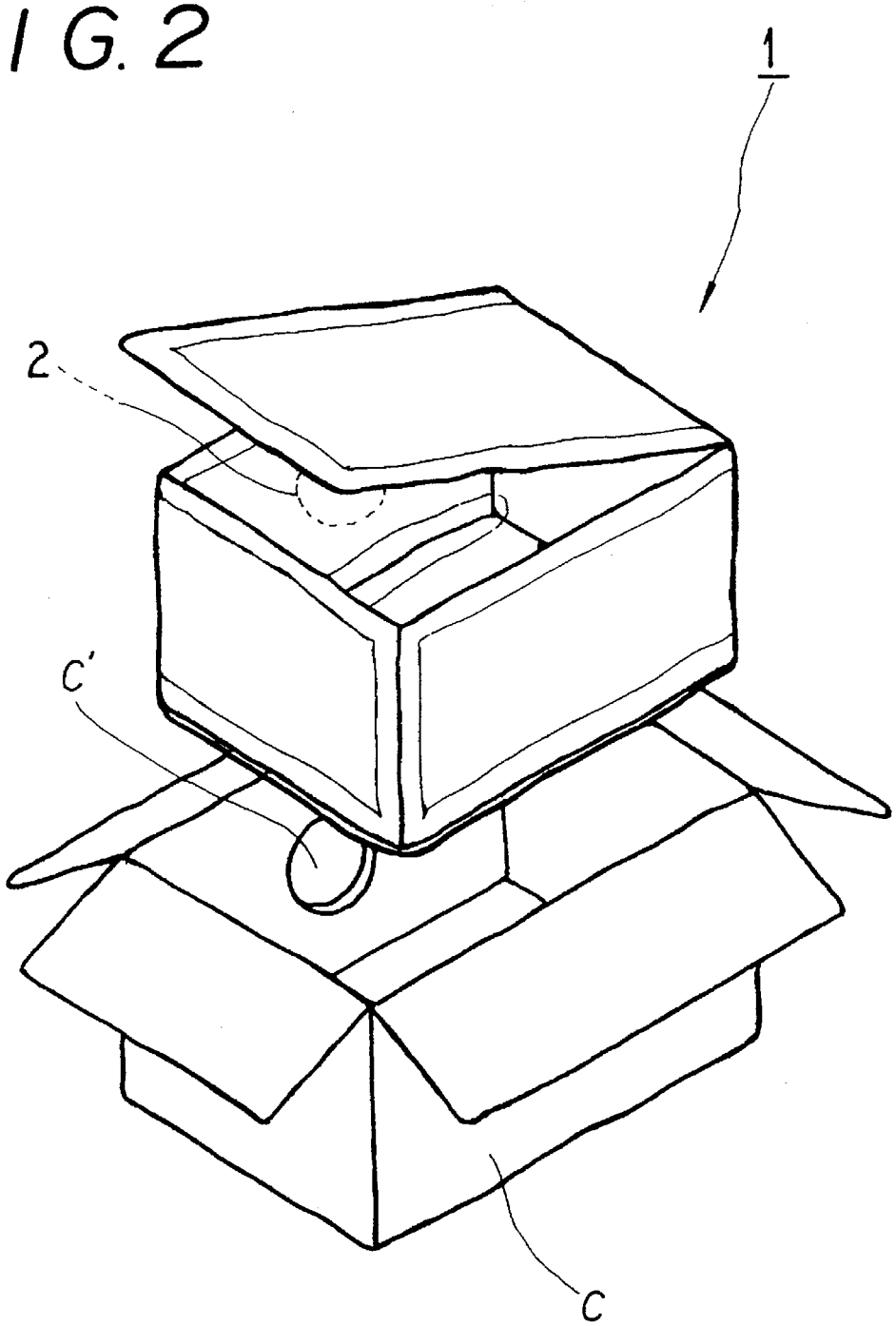
FIG. 2 is a perspective view showing an example of the application of the wrapping system of FIG. 1.

According to this embodiment for use in the impact-resistant wrapping system, as shown in FIG. 2, the sheetlike wrapping body 1 is bent to correspond to the ceiling surface, the bottom surface and the side surfaces of the box C, and the sheetlike wrapping body 1 is placed in the box C along the bottom and side surfaces of the box C when the ceiling surface is open. While the portion of the sheetlike wrapping body 1 which corresponds to the ceiling surface and the ceiling surface of the box C are kept open, an article P is accommodated in the box C by the sheetlike wrapping body 1. Then the portion of the sheetlike wrapping body 1 which corresponds to the ceiling surface of the box and the ceiling portion of the box are closed. At this time, no problem arises even if a slight play is present between the box C and the article P, thereby facilitating the accommodation of the particle P. The seal 24 of the air valve 2 is peeled from the base 22 to remove the cutter 23, and the flexible wall member 11 of the sheetlike wrapping body 1 is cut along the slit 21 with the cutter 23. Only the operation of the air valve 2 is added to the conventional operations, and thus cumbersome wrapping operations are not required.

When the flexible wall member 11 of the sheetlike wrapping body 1 is cut with the cutter 23 in the air valve 2, the cavity 13 of the sheetlike wrapping body 1 can communicate with external space. Air is drawn into the cavity 13 of the sheetlike wrapping body 1 through the cut portion, and the elastic, impact-resistant material 14 expands by virtue of its elasticity.

When the elastic impact-resistant material 14 expands, the sheetlike wrapping body 1 expands like a mat to absorb the play between the box C and the article P. The sheetlike wrapping body 1 is pressed against both the box C and the article P with much elastic force, and then the article P is properly fixed inside the box C.

If the box C is a blind box having no through or window holes, an operation hole punch as window hole C', which allows the operation of the air valve 2, must be formed in the box C. If any handgrip hole which is formed in the box C is constituted by a blind hole, the position of the air valve 2 is set so as to be opposite the handgrip hole. In this manner, the handgrip hole can be used as the operational window hole C'.

To unwrap the article P, the ceiling surface of the box C and the portion of the sheetlike wrapping body 1 which corresponds to the ceiling surface of the box C are opened to remove the article P. In this case, if the expanded sheetlike wrapping body 1 interferes with unwrapping, the sheetlike wrapping body 1 is evacuated (i.e. a home vacuum cleaner can be used) through the cut portion of the slit 21 of the air valve 2 to exhaust the air from the cavity 13 of the sheetlike wrapping body 1, thereby shrinking the elastic, impact-resistant material 14 and the sheetlike wrapping body 1. This shrunken state can be maintained by adhering the seal 24 to the base 22 of the air valve 2, and the impact-resistant wrapping system can be used again. This state can be released by peeling off the seal 24. For this reason, the flexible wall member 11 of the sheetlike wrapping body 1 need not be cut with the cutter 23 upon reusing the system.

Figure 6:
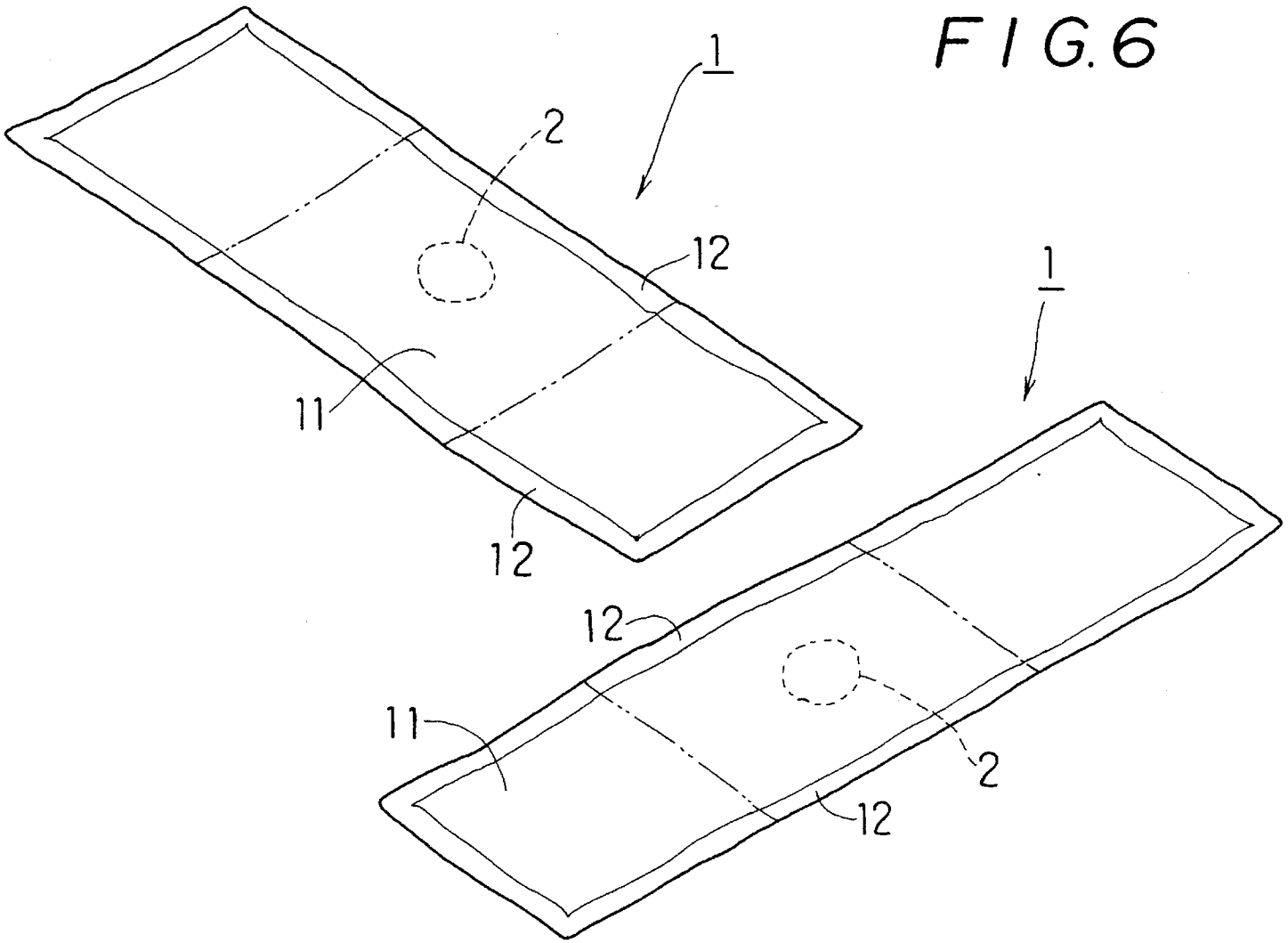
FIG. 6 is a perspective view showing an impact-resistant wrapping system according to a second embodiment of the present invention.

FIG. 6 shows an impact-resistant wrapping system according to a second embodiment of the present invention.

In this embodiment, the sheetlike wrapping body 1 of the first embodiment is constituted by two I-shaped sheetlike wrapping bodies, each corresponding to three surfaces of a box C. An air valve 2 is mounted in each I-shaped sheetlike wrapping body.

According to this embodiment, the I-shaped sheetlike wrapping body 1 can be manufactured easier than the cross-shaped sheetlike wrapping body 1 of the first embodiment.

Figure 7:
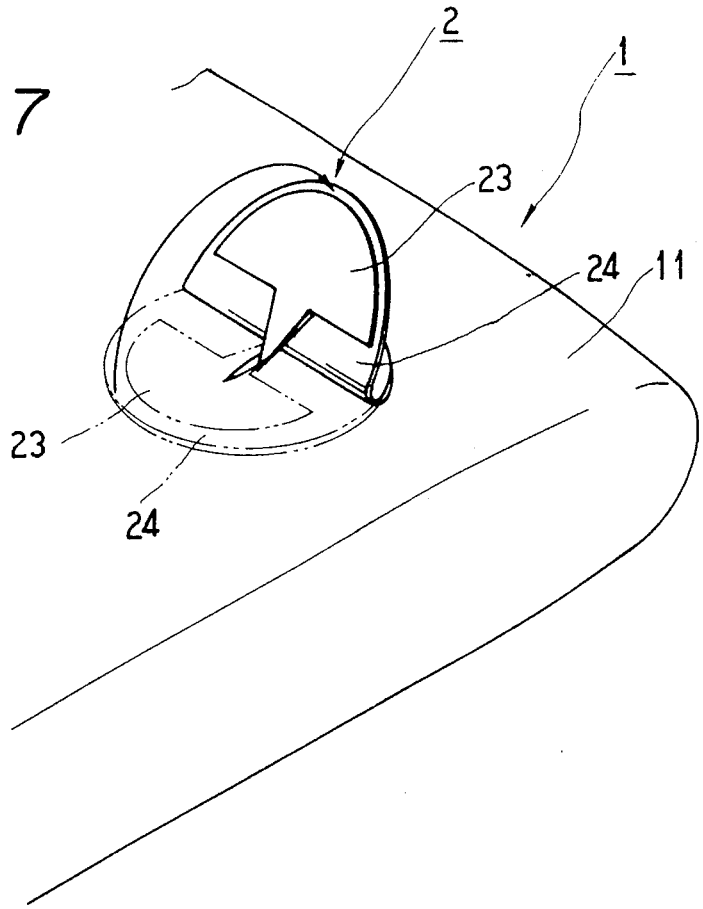
FIG. 7 is a perspective view showing a main part (air valve) of an impact-resistant wrapping system according to a third embodiment of the present invention.

FIG. 7 shows an impact-resistant wrapping system according to a third embodiment of the present invention.

In this embodiment, the base 22 (and slit 21) of the air valve 2 of the first embodiment is omitted. A cutter 23 is fixed to a seal 24, and the seal 24 is directly adhered to the flexible wall member 11 of the sheetlike wrapping body 1.

According to this embodiment, the position of the air valve 2 can be arbitrarily set to correspond to the size and shape of a box C immediately prior to the use of the impact-resistant wrapping system.

Figure 8:
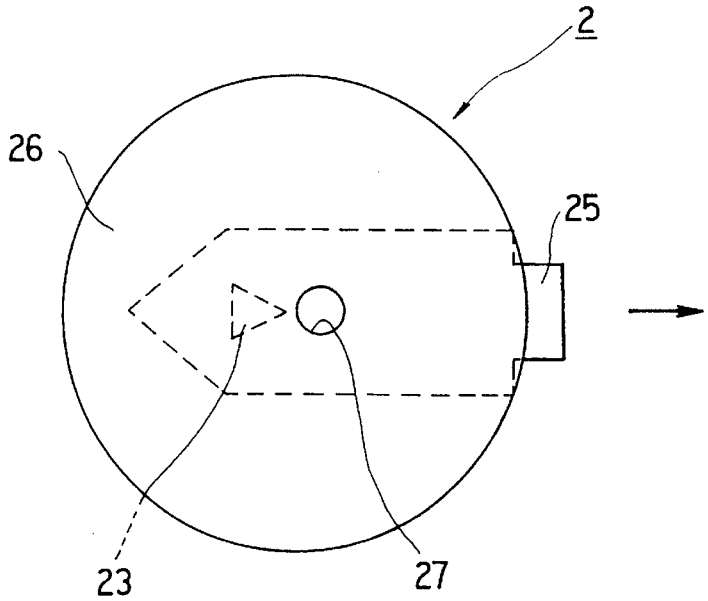
FIG. 8 is a plan view showing the main part (air valve) of an impact-resistant wrapping system according to a fourth embodiment of the present invention.
Figure 9:
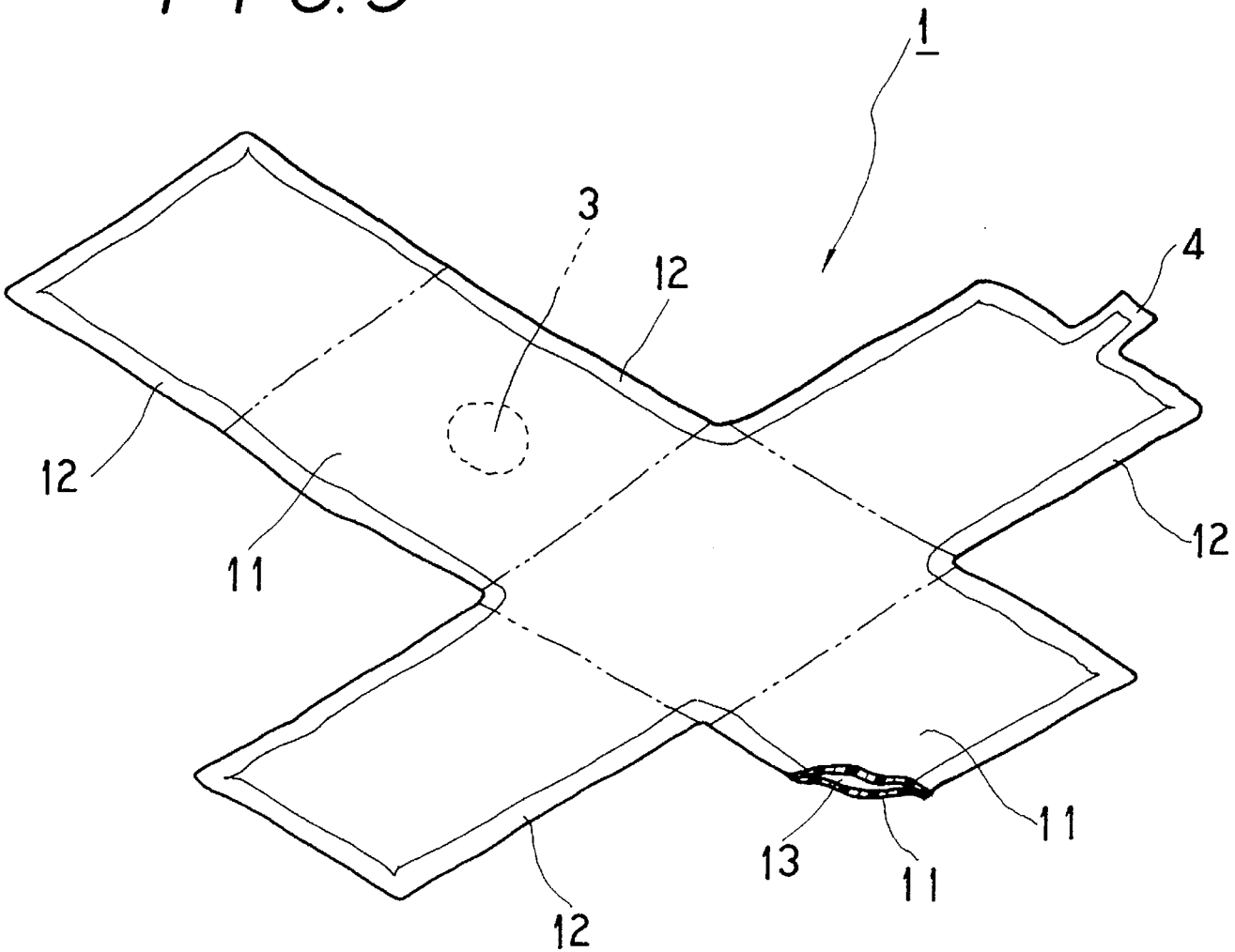
FIG. 9 is a partially cutaway, perspective view showing an impact-resistant wrapping system according to a fifth embodiment of the present invention.
Figure 10:
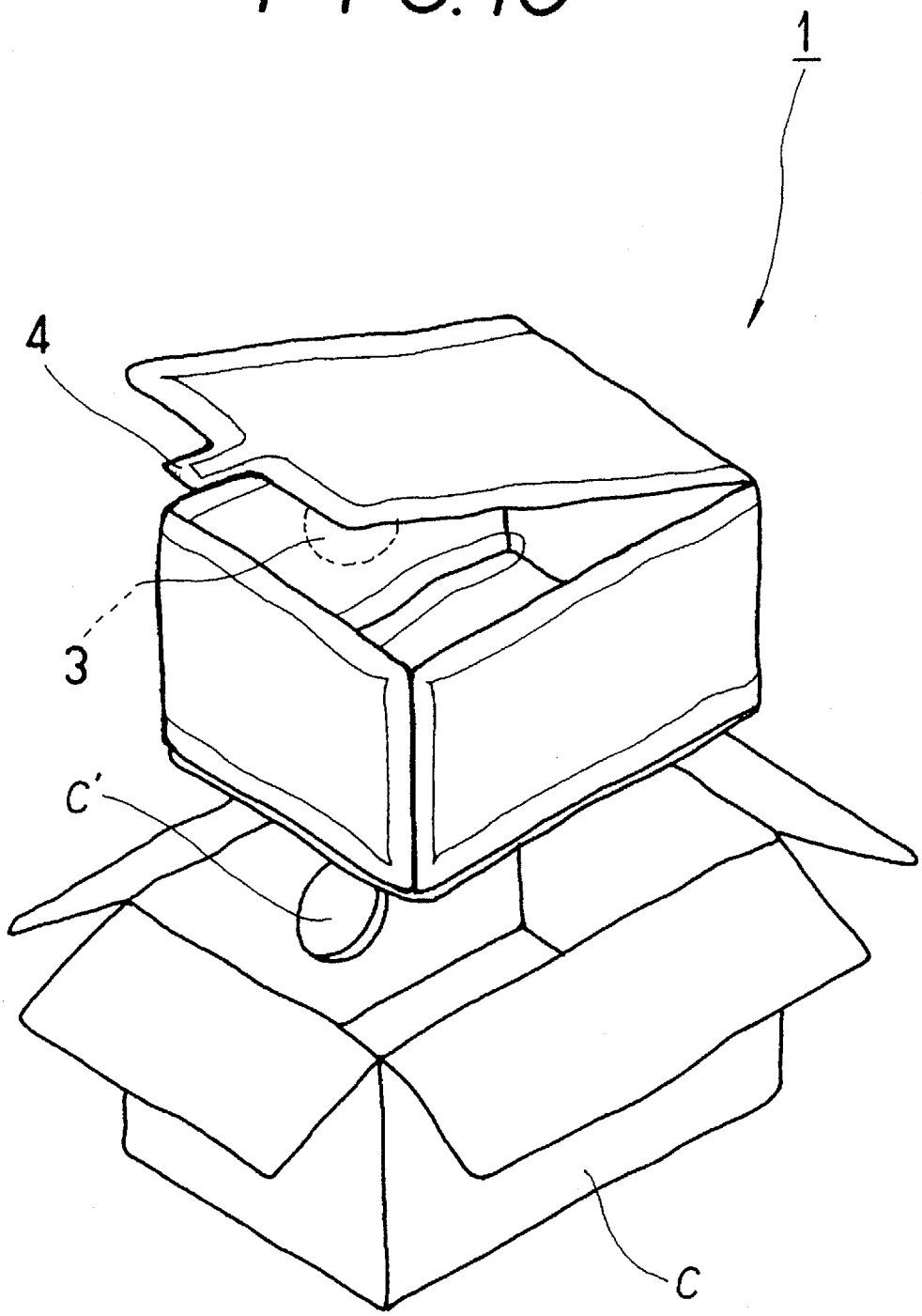
FIG. 10 is a perspective view showing a state of application of the system of FIG. 9.

FIG. 8 shows an impact-resistant wrapping system according to a fourth embodiment of the present invention.

In this embodiment, a slidable opening and closing plate 25 is mounted to serve as a piercing member for raising the cutter 23 of the air valve 2 of the first embodiment. A communication hole 27 of an upper plate 26 abutting against the opening and closing plate 25 is opened and closed by the opening and closing plate.

According to this embodiment, the air valve 2 can be opened and closed by means of a simple operation, such as sliding the opening and closing plate 25.

FIGS. 9 to 15 show an impact-resistant wrapping system according to a fifth embodiment of the present invention.

In this embodiment, the elastic, impact-resistant material 14, which is accommodated in the cavity 13, and the air valve 2, which is mounted in the flexible wall member 11 in the sheetlike wrapping body 1 of the first embodiment, are omitted. Instead, a gas-generating capsule 3, which is capable of generating a gas G that is nontoxic to man, such as oxygen, nitrogen or carbon dioxide, is accommodated inside a cavity 13.

Figure 11A:
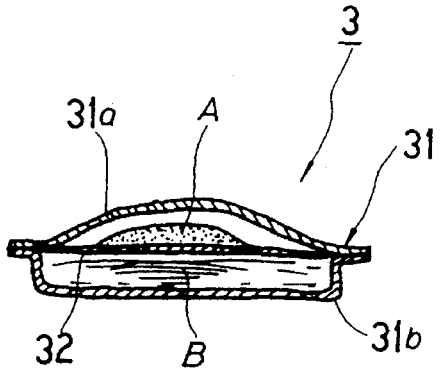
FIGS. 11A to 11C are sectional views showing operating states of a main part (gas generating capsule) of FIG. 9.
Figure 11B:
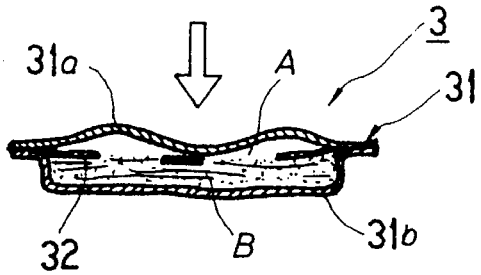
Figure 11C:
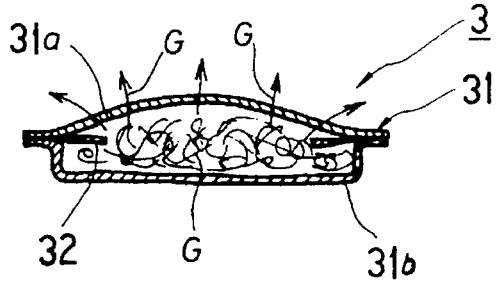

As shown in FIGS. 11A to 11C in detail, the gas-generating capsule 3 has a partition film 32 inside a vessel 31. In this gas-generating capsule 3, one material A consisting of a liquid or solid material is separated from the other material consisting of a liquid or solid material through the partition film 32. When the partition film 32 is eliminated, these materials A and B are mixed with each other to cause a chemical reaction, thereby generating the gas G. For example, if the gas G is oxygen, the material A consists of manganese dioxide and the material B consists of an aqueous solution of hydrogen peroxide. A variety of solid materials, each of which is obtained by bonding a water-soluble derivative to a gas as a material for chemical experiments, horticulture or aquariums have become available recently. Such a material can be used as the material A, while water is used as the material B. Preferably, materials A and B, which do not chemically react with each other at a high temperature, nor cause a chemical reaction to produce a gas which may damage the vessel 31, are selected. In the gas-generating capsule 3 as shown in FIGS. 11A to 11C, a half 31*a* of the vessel 31, which is partitioned off by the partition film 32, is made of a flexible material, and it is depressed and deformed to eliminate the partition film 32. The other half 31*b* of the vessel 31 is made of a hard material so that the vessel 31 can withstand a depressive force or impact, while the vessel 31 itself will not be eliminated. The half 31*a* of the vessel 31 is made of a synthetic material having mazelike pores. The half 31*a* is permeable only to the gas G to prevent a liquid or the like from leaking outside the vessel 31.

Figure 12:
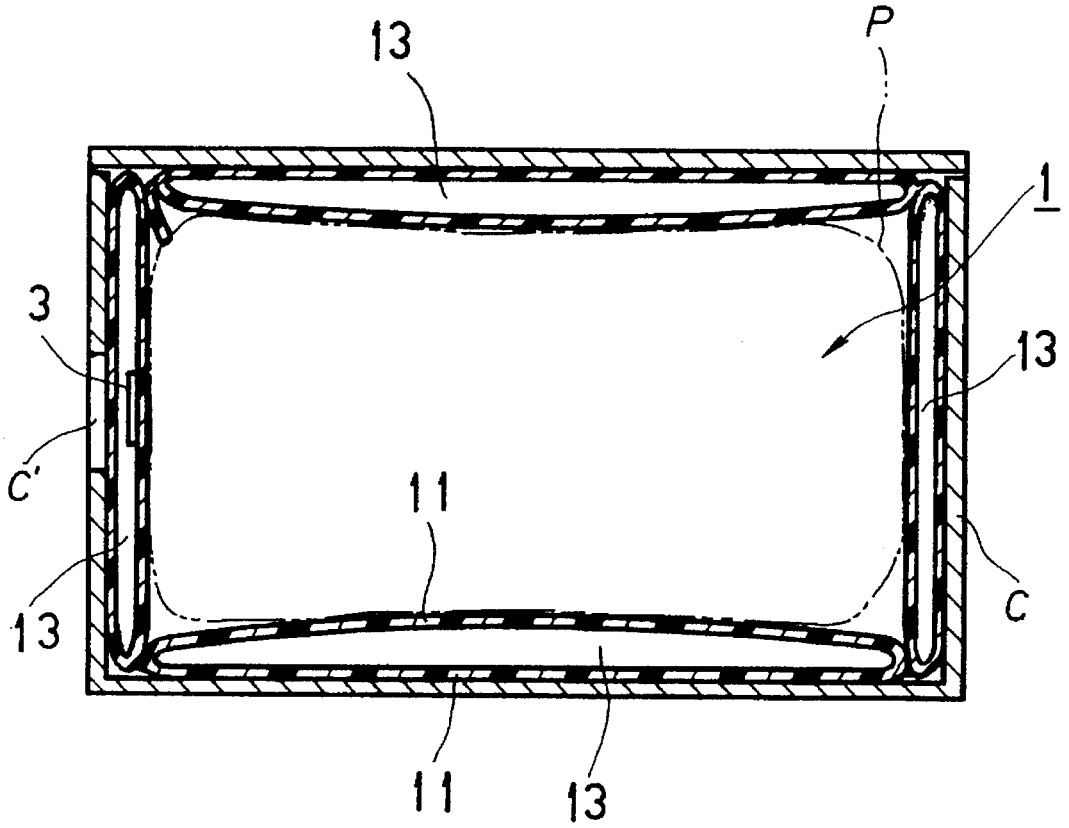
FIG. 12 is a sectional view showing a state wherein wrapping has been completed from the state which is shown in FIG. 10.

The gas G which has permeated through the vessel 31 is filled in to the cavity 13 by the cubical expansion of the gas G of the sheetlike wrapping body 1 in order to expand the cavity 13 (FIG. 12).

In addition, an exhaust-air valve 4 communicating with the cavity 13 and capable of exhausting the gas G outside the cavity 13 is mounted in the sheetlike wrapping body 1 of this embodiment.

Figure 13:
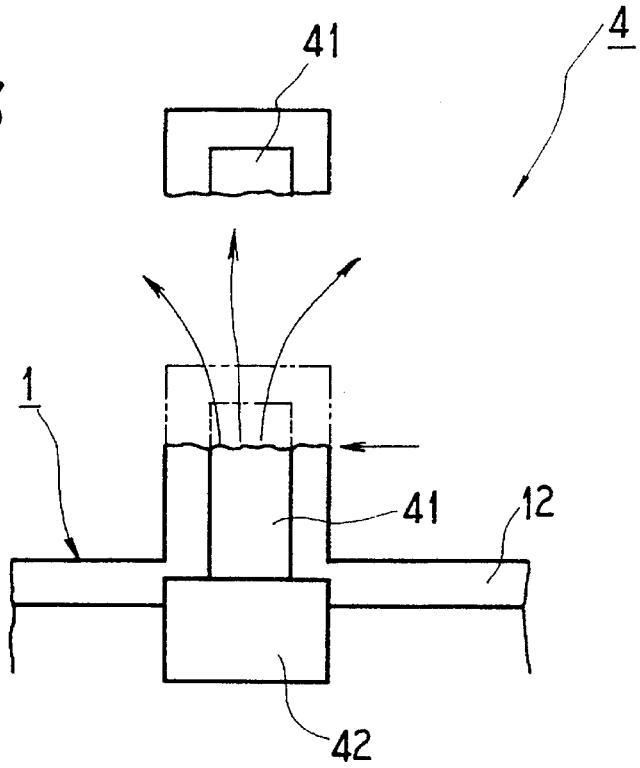
FIG. 13 is a plan view showing a state of application of another main part (air valve) of FIG. 9.
Figure 14:
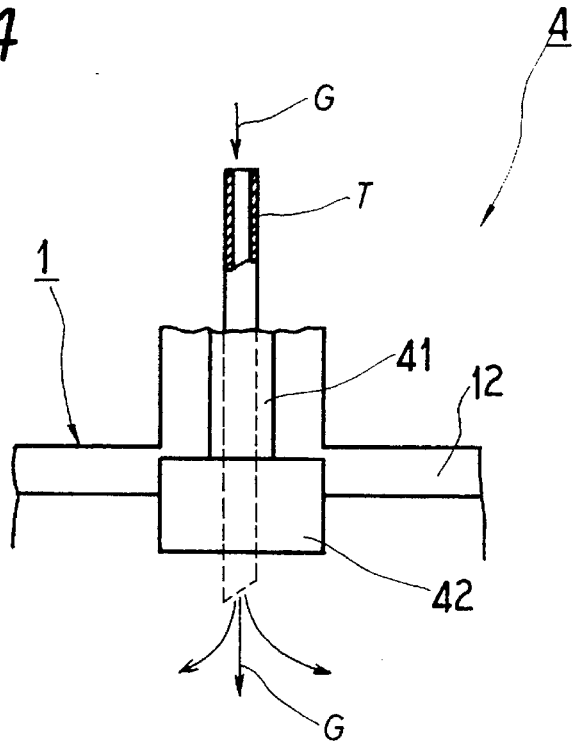
FIG. 14 is a plan view showing another state of application of the main part in FIG. 13.
Figure 15:
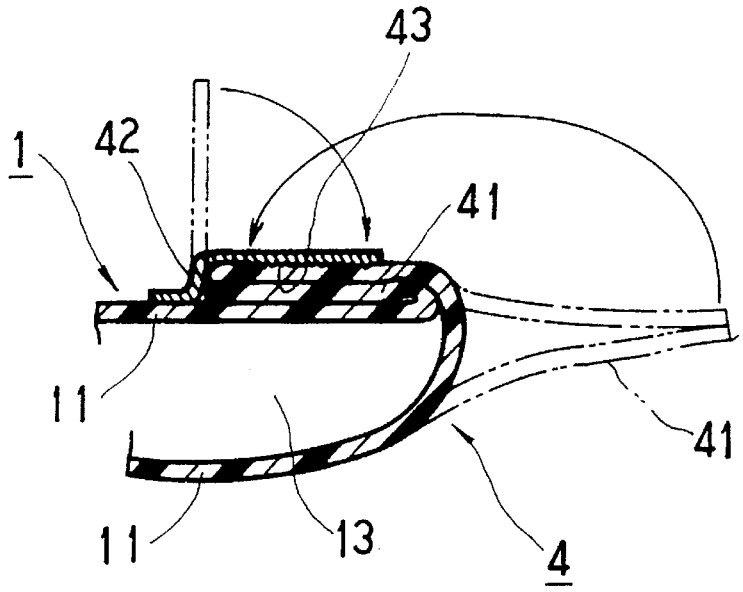
FIG. 15 is a sectional view showing a sealed state when using the wrapping system of FIG. 14.

The exhaust-air valve 4 comprises a projecting piece 41 which slightly extends from one side of the sheetlike wrapping body 1, and it is obtained by extending the corresponding seal portion 12 along the edge of this side. A seal piece 42 is partially fixed to the outer surface of the flexible wall member 11 near the projecting piece 41, and a pressure-sensitive adhesive 43 is applied to a nonfixed surface of the seal piece 42 on the side of flexible wall member 11. As shown in FIG. 13, when the distal-end portion of the projecting piece 41 is cut, the gas G, which has been filled into the cavity 13 of the sheetlike wrapping body 1, can be exhausted. As shown in FIG. 14, a tube T, such as a straw, is inserted from the cut end of the projecting piece 41 to allow injection of the gas or air into the cavity 13 of the sheetlike wrapping body 1. As shown in FIG. 15, after the gas G, air or the like is injected into the cavity 13 of the sheetlike wrapping body 1, the projecting piece 41 is folded toward side of the sheetlike wrapping body 1. The seal piece 42 is placed on the folded portion and adhered thereto by means of the pressure-sensitive adhesive 43. Then, the injected gas G, air or the like is sealed into the cavity 13 of the sheetlike wrapping body 1.

According to this embodiment, when using the impact-resistant wrapping system, the gas generating capsule is depressed instead of opening and closing the air valve in each of the first to fourth embodiments. As a result, the same effect as in the first to fourth embodiments can be obtained in the fifth embodiment. The impact-resistant wrapping system of the fifth embodiment can be used again as in the first to fourth embodiments, although the former makes use of injection, while the latter uses evacuation.

Figure 16:
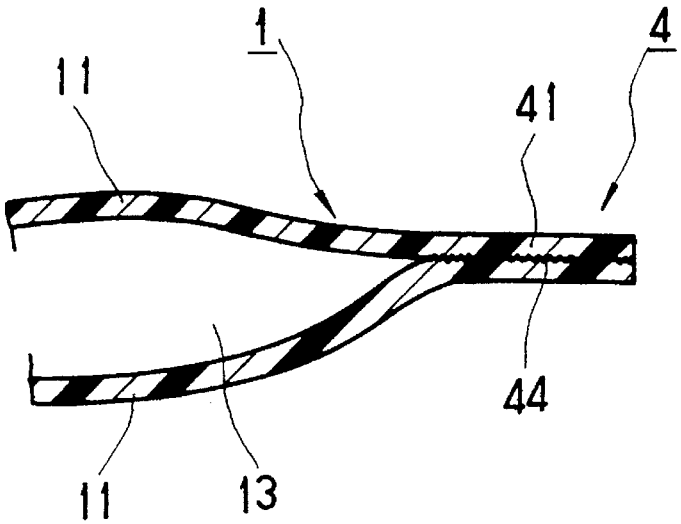
FIG. 16 is a sectional view showing a main part (gas valve) of an impact-resistant wrapping system according to a sixth embodiment of the present invention.

FIG. 16 shows an impact-resistant wrapping system according to a sixth embodiment of the present invention.

In this embodiment, the air valve 4 of the fifth embodiment is arranged in such that a way that an adhesive 44 for effecting repeated adhesion and peeling is applied to the inner surface of the projecting piece.

According to this embodiment, the structure of the air valve 4 can be simplified and manufactured with ease at low cost.

In addition to the illustrated embodiments under each of the fifth and sixth embodiments, an elastic impact-resistant material 14 can be compressed and stuffed inside the cavity 13 of the sheetlike wrapping body as in the first to fourth embodiments described above.

In such an embodiment, the elastic impact-resistant material 14 may be used to perform an impact-resistant wrapping function, even if a flexible wall member 11 of the sheetlike wrapping body 1 is damaged and leaks the gas G during use.

As many apparently widely different embodiments of the present invention may be made without departing from the spirit and scope thereof, it is to be understood that the invention is not limited to the specific embodiments thereof, except as defined in the appended claims.

What is claimed is:

1. An impact-resistant wrapping system, comprising:

at least one wrapping body, each said wrapping body comprising:

flexible wall members that are substantially gas impermeable, a cavity surrounded and defined by said flexible wall members, and a compressed elastic impact-resistant material accommodated in said cavity defined by said flexible wall members, said compressed elastic impact-resistant material being expandable upon exposure to a gas;

wherein said at least one wrapping body is foldable and conformable to ceiling, bottom and side surfaces of a box;

an air valve mounted on one of said flexible wall members of said at least one wrapping body, said air valve defining a means for opening communication between said cavity, and thus said compressed elastic impact-resistant material in said cavity, and the exterior of said flexible wall members, and for closing off communication between said cavity, and thus said compressed elastic impact-resistant material in said cavity, and the exterior of said flexible wall members; and a gas-generating capsule accommodated in said cavity of each said wrapping body, said gas-generating capsule comprising at least two types of materials that are separately sealed therein and that are mixable with each other upon said gas-generating capsule being pressed, said at least two types of materials having the properties of generating a gas upon being mixed with each other, and said gas-generating capsule at least partly comprising a portion permeable to the gas generated by said two types of materials, whereby said cavity of each said wrapping body can be inflated by the gas generated by pressing said gas-generating capsule so as to mix said at least two types of materials and the gas exiting said gas-generating capsule through said portion permeable to the gas.

2. The system of claim 1, wherein said gas-generating capsule comprises one vessel half made of a hard material, another vessel half connected to said one vessel half and comprising said portion permeable to the gas, and a partition film separating said at least two types of materials.

3. The system of claim 1, wherein said at least one wrapping body comprises a single wrapping body that is cross-shaped when unfolded.

* * * * *